United States Patent [19]

Kobayashi

[11] Patent Number: 4,802,668

[45] Date of Patent: Feb. 7, 1989

[54] TOY GAME APPARATUS

[75] Inventor: Toshio Kobayashi, Chiba, Japan

[73] Assignee: Asahi Corporation, Tokyo, Japan

[21] Appl. No.: 129,822

[22] Filed: Dec. 7, 1987

[30] Foreign Application Priority Data

Dec. 6, 1986 [JP] Japan ..... 61-188014

[51] Int. Cl.[4] ..... A63F 9/00

[52] U.S. Cl. ..... 273/1 GE; 273/1 GG

[58] Field of Search ..... 273/1 GE, 1 GF, 1 GG, 273/1 GC

[56] References Cited

U.S. PATENT DOCUMENTS

| | | | |
|---|---|---|---|
| 2,917,310 | 12/1959 | Durrell | 273/1 GE X |
| 3,112,929 | 12/1963 | Gisser | 273/1 GC |
| 3,754,759 | 8/1973 | Breslow et al. | 273/1 GE |
| 4,306,717 | 12/1981 | Todokoro | 273/1 GE |

*Primary Examiner*—Paul E. Shapiro

*Attorney, Agent, or Firm*—Salter & Michaelson

[57] ABSTRACT

An action toy game apparatus includes a base, a timer in the base, a plurality of magnetically responsive ring-like game elements, a feeder mechanism for individually feeding the game elements to a feeder station, and a magnetic support mechanism for individually magnetically receiving the game elements from the feeder mechanism and for moving them in a substantially circular path which is spaced upwardly from the base. The apparatus further includes a retrieving mechanism which is operable for individually retrieving the game elements from the support mechanism as they are moved in the substantially circular path and a removing mechanism for removing any of the game elements from the support mechanism in the event that they are not retrieved with the retrieving mechanism. The retrieving mechanism comprises a character figure member holding an upwardly disposed elongated rod and a depressible member which is manually operably for moving the character figure member and the rod upwardly in order to individually retrieve the game elements on the rod as they are moved in the substantially circular path above the base.

9 Claims, 4 Drawing Sheets

TOY GAME APPARATUS

BACKGROUND AND SUMMARY OF THE INVENTION

The instant invention relates to amusement game apparatus and more particularly to a toy game apparatus for playing an amusement game of the general type wherein a game player must successfully perform certain feats within a set period of time in order to achieve a game score.

It has been found that game apparatus which are operative with interesting and unusual forms of action movement often have significant levels of appeal and that game apparatus of this type which require game players to successfully perform certain feats within set periods of time often have even greater levels of appeal. Still further, it has been found that game apparatus which are adapted for use by children and which require game players to skillfully perform certain manipulative operations within set periods of time can aid in the development of hand-to-eye coordination and manual dexterity.

The instant invention provides an effective action toy game apparatus which is operative with highly interesting and amusing action movements and which is adapted for playing a game wherein a game player must skillfully perform certain manipulations within a set period of time in order to achieve a game score. More specifically, the instant invention provides an action toy game apparatus comprising a base, a timer mounted in the base and actuatable for a set period of time, a plurality of magnetically responsive game elements, feeder means for sequentially feeding the game elements to a feeder station, and magnetic support means mounted on the base and communicating with the timer for rotating the support means when the timer is in an actuated condition. The magnetic support means is operative for individually receiving sequential game elements from the feeder means at the feeder station and for magnetically supporting them so that they are individually moved in a substantially circular path which is spaced upwardly from the base when the timer is in an actuated condition. The apparatus further comprises retrieving means on the base which is operative for individually retrieving the game elements from the support means as they are moved in the substantially circular path, and the game elements preferably comprise substantially circular metal rings. The retrieving means preferably comprises a character figure holding an elongated rod, and the retrieving means is preferably operative by manually depressing a depressible member on the base in order to move the character figure upwardly for retrieving the game elements with the elongated rod. The feeder means preferably comprises a ramp which is adapted for maintaining the rings in substantially upright dispositions and for positioning them so that they sequentially roll toward the feeder station as the game elements are individually received by the support means. The feeder means preferably further comprises a holding member at the feeder station for individually receiving sequential rings from the ramp and for individually holding them in substantially vertical dispositions at the feeder station, and the holding member is preferably pivotably mounted about a substantially horizontal axis for individually passing the rings to the support means as the support means is moved over the feeder station. The support means preferably comprises at least one support arm having a magnetic outer end, and the support means is preferably adapted so that the support arm pivots about a substantially vertical axis when the timer is in an actuated condition for moving the magnetic outer end of the support arm in a path which passes over the feeder station and then over the retrieving means. Still further, the support means is preferably adapted so that the magnetic outer end of the support arm is lowered slightly as it passes over the feeder station for receiving a game element, and then raised slightly as it passes over the retrieving means. The apparatus preferably still further comprises means for individually removing the game elements from the support means after the game elements have been passed over the retrieving means and before they have been moved in a complete revolution in the event that they have not been retrieved by the retrieving means.

Accordingly, for use and operation of the game apparatus of the instant invention, the game elements are positioned on the ramp so that the first game element passes into the holding member, and the timer is moved to an actuated position so that the support arm is moved in a substantially circular path which is spaced upwardly from the base. As the support arm is moved over the feeder station, the game element in the holding member is magnetically attracted to the magnetic outer end of the support arm, and the holding member is tilted about a substantially horizontal axis so that the game element can be effectively passed to the magnetic outer end of the support arm. As the support arm is pivoted further, the game element and the magnetic outer end of the support arm are moved over the retrieving means. Accordingly, the game element can be retrieved with the retrieving means by depressing the depressible member at the appropriate time in order to move the elongated rod upwardly so that it passes through the ring-like game element. However, if the game element is not retrieved with the retrieving means, the game element is moved further around the circular path above the base until it is removed from the magnetic outer end of the support arm by the removing means, and this procedure is then repeated until the set period of time as determined by the timer has expired, whereupon rotation of the support means is terminated.

Accordingly, it is a primary object of the instant invention to provide an effective and amusing action toy game apparatus.

Another object of the instant invention is to provide an effective action toy game apparatus which is operative with highly interesting and amusing action movements.

An even further object of the instant invention is to provide an action toy game apparatus which is adapted for use by children and which can be utilized to aid in the development of hand-to-eye coordination and manual dexterity.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
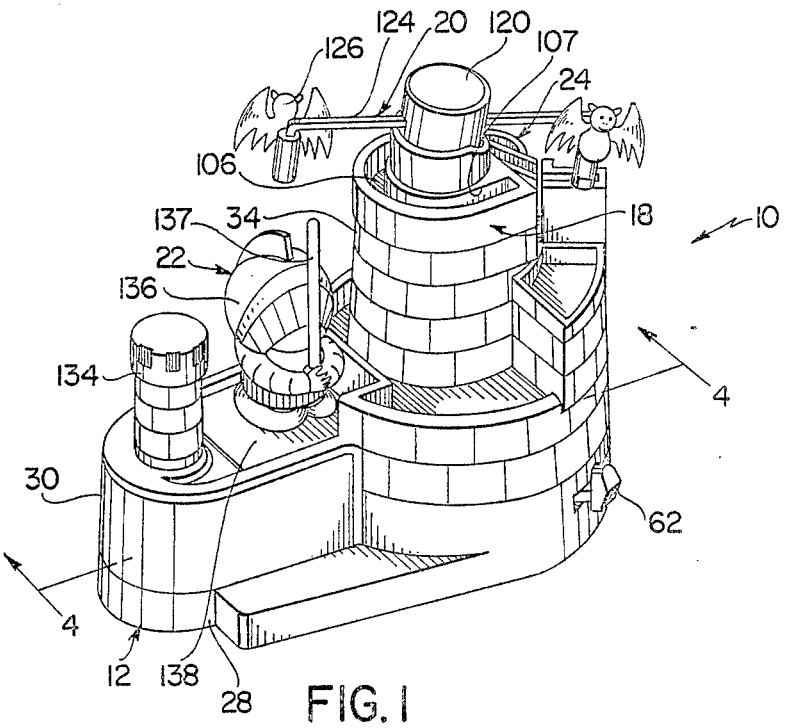
FIG. 1 is a perspective view of the game apparatus of the instant invention.
Figure 2:
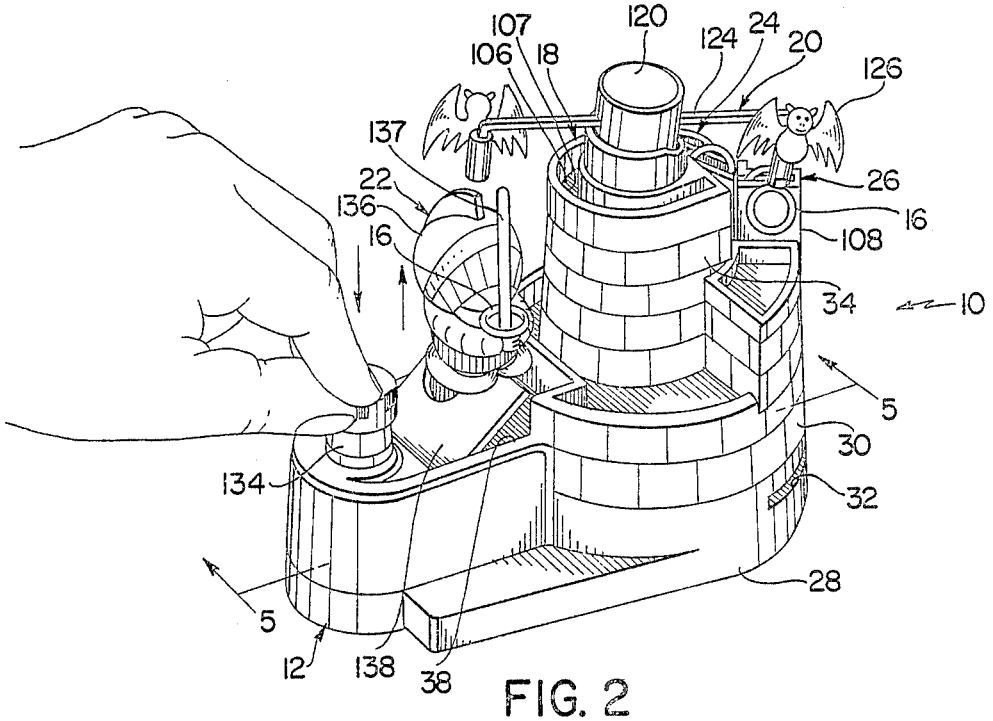
FIG. 2 is a similar perspective view of the game apparatus illustrating the operation of the retrieving mechanism for retrieving a game element.

Referring now to the drawings, the game apparatus of the instant invention is illustrated and generally indicated at 10 in FIGS. 1 through 5, and it comprises a base generally indicated at 12, a timer generally indicated at 14 and mounted in the base 12, a plurality of magnetically responsive game elements 16, a feeder assembly generally indicated at 18, a support mechanism generally indicated at 20, a retrieving mechanism generally indicated at 22, and a removing mechanism generally indicated at 24. For use and operation of the apparatus 10, the timer 14 is actuatable for a set period of time, and the feeder assembly 18 is operative for sequentially feeding the game elements 16 to a feeder station 26. The support mechanism 20 is operative for individually receiving the game elements 16 from the feeder assembly 18 at the feeder station 26 and for moving the game elements 16 in a substantially circular path which is spaced upwardly from the base 12. The retrieving mechanism 22 is operative for individually retrieving the game elements 16 from the support mechanism 20 as they are moved in the substantially circular path above the base 12, and the removing mechanism 24 is operative for individually removing the game elements 16 from the support mechanism 20 after the game elements 16 have been passed over the retrieving mechanism 22 in the event that they have not been retrieved by the retrieving mechanism 22.

The base 12 comprises lower and upper housing sections 28 and 30, respectively, which are preferably molded from a suitable plastic material and which cooperate to define an elongated slot 32. The base 12 further comprises a support tower section 34 which extends upwardly from the upper housing section 30, and the removing mechanism 24 and portions of the feeder assembly 18 are integrally formed with the support tower section 34 as will hereinafter be more fully set forth. Formed in the upper housing section 30 are a substantially circular opening 36 and a substantially rectangular opening 38 which is disposed adjacent the opening 36; and an aperture 40 is formed in the upper end of the support tower section 34. The base 12 as herein embodied is formed in the configuration of a fanciful medieval tower, although it will be understood that other embodiments which include base structures of various other configurations are contemplated.

The timer 14 is mounted in the base 12, and it comprises a timer housing generally indicated at 42, a winding mechanism generally indicated at 44, a decay mechanism generally indicated at 46, and a coupling gear 48. The housing 42 is preferably molded from a suitable plastic material, and it comprises lower and upper housing sections 50 and 52, respectively, and a partition 54 which separates the lower and upper housing sections 50 and 52, respectively. The lower housing section 50 and the partition 54 cooperate to define an elongated slot 56, and an open notch 58 is formed in the upper housing section 52. Extending upwardly from the upper housing section 52 is an integrally formed tubular neck portion 60.

Figure 8:
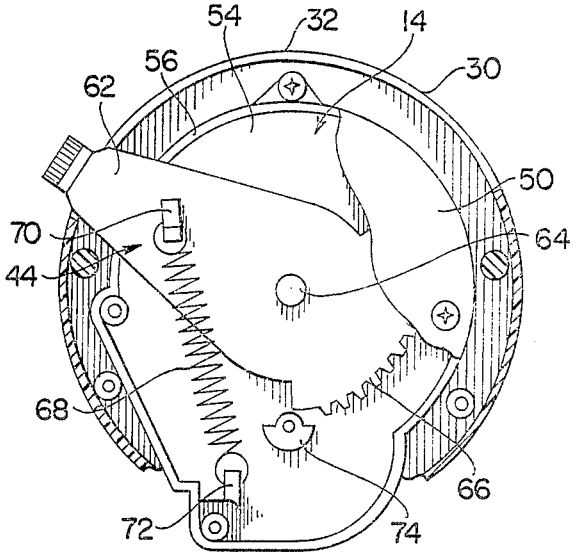
FIG. 8 is a sectional view taken along line 8—8 in FIG. 4.
Figure 9:
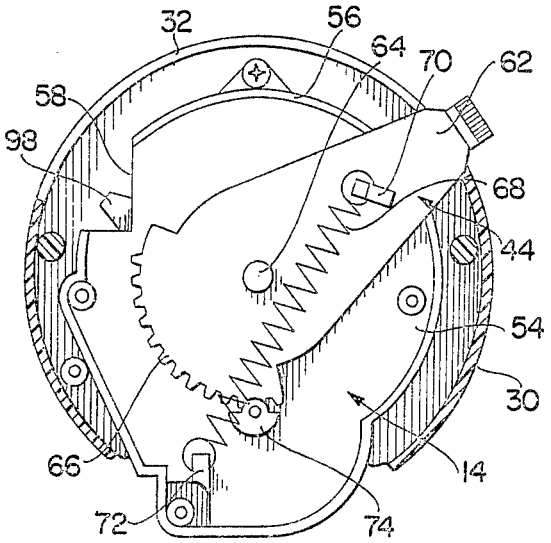
FIG. 9 is a sectional view similar to that shown in FIG. 8 with the timer in an actuated position.

The winding mechanism 44 is illustrated most clearly in FIGS. 8 and 9, and it comprises a winding arm 62 which is pivotably mounted on the shaft 64 on the partition 54, a fan gear 66 which is integrally formed with the winding arm 62, and a winding spring 68. Lugs 70 and 72 are integrally formed on the winding arm 62 and on the partition 54, respectively, and the spring 68 is assembled so that it extends between the lugs 70 and 72 for biasing the winding arm 62 to the unwound position thereof illustrated in FIG. 8. The winding arm 62 is pivotable on the shaft 64 against the force of the winding spring 68 in order to move it to the fully wound position illustrated in FIG. 9. In this connection, as illustrated in FIG. 9, when the winding arm 62 is in the wound position thereof, the fan gear 66 passes through an open gear housing 74 which is integrally formed on the partition 54 so that the fan gear 66 communicates with the decay mechanism 46 in the housing 74. However, when the winding mechanism 44 is advanced to the fully unwound position thereof illustrated in FIG. 8, the fan gear 66 is removed from the gear housing 74 so that it no longer communicates with the decay mechanism 46.

Figure 7:
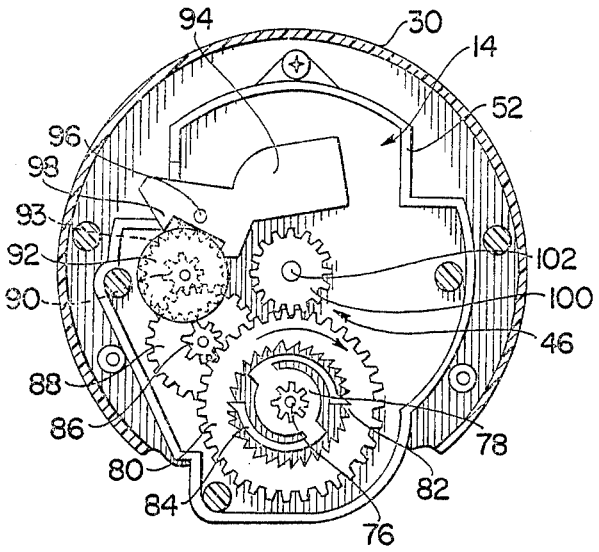
FIG. 7 is a sectional view taken along line 7—7 in FIG. 4.

Referring to FIG. 7, the decay mechanism 46 comprises a main drive gear 76, a ratchet ring 78, and an intermediate drive gear 80, all of which are coaxially mounted on a common shaft in the upper timer housing section 52. The intermediate drive gear 80 has a substantially circular central recessed area formed therein, and a plurality of ratchet teeth 82 are formed in the intermediate drive gear 80 so that they project inwardly into the central recessed area therein. The ratchet ring 78 is integrally formed with the main drive gear 76 so that it rotates therewith, and it includes a pair of outwardly extending ratchet arms 84 which are engageable with the ratchet teeth 82 for communicating rotation from the main drive gear 76 to the intermediate drive gear 80 in the direction illustrated in FIG. 7. However, the ratchet arms 84 are formed so that when the main drive gear 76 is rotated in the reverse direction, the ratchet arms 84 pass over the ratchet teeth 82 to permit relative rotation between the main drive gear 76 and the intermediate drive gear 80. The decay mechanism 46 further comprises a first transmission gear 86, a second transmission gear 88 which is integrally formed with the first transmission gear 86, an escapement wheel drive gear 90, and an escapement wheel 92. The first and second transmission gears 86, respectively, are mounted on a common shaft, and the first transmission gear 86 is positioned for intermeshing engagement with the intermediate drive gear 80. The escapement wheel drive gear 90 and the escapement wheel 92 are integrally formed and coaxially mounted on a common shaft so that the escapement wheel drive gear 90 is positioned for intermeshing engagement with the second transmission gear 88 in order to communicate rotation from the intermediate drive gear 80 to the escapement wheel 92. The escapement wheel 92 is formed so that it includes a plurality of peripheral pointed or V-shaped teeth 93, and the decay mechanism 46 further comprises an escapement arm 94 which is pivotably mounted in the upper housing section 52 about an axis 96. In this connection, the escapement arm 94 comprises a pair of spaced jaws 98, one of which projects into the notch 58, and the escapement arm 94 is constructed so that the jaws 98 are alternatively engageable with the teeth 93 for oscillating the escapement arm 94 back and forth as the jaws 98 pass from tooth 93 to tooth 93 whenever the escapement wheel 92 is rotated. Accordingly, the decay mechanism 46 is adapted so that the arm 94 oscillates back and forth whenever the intermediate drive gear 80 is rotated by the ratchet ring 78. This performs the dual function of producing a ticking sound as the timer 14 is advanced toward the unwound position thereof and of retarding the advancement of the winding mechanism 44 so that the timer 14 is advanced toward the unwound position thereof at a controlled rate. The decay mechanism 46 further comprises a coupling drive gear 100 which is mounted on a shaft 102 and positioned for intermeshing engagement with the intermediate drive gear 80 so that the shaft 102 is rotated whenever the intermediate drive gear 80 is rotated. The coupling gear 48 is mounted on the shaft 102 in the neck portion 60, and it is of substantially circular disc-shaped configuration. The coupling gear 48 includes an upwardly facing multitoothed coupling ring 104 which is receivable in intermeshing engagement with a corresponding coupling gear in the support mechanism 20 as will hereinafter be more fully set forth.

Accordingly, for use and operation of the timer 14, the winding arm 62 is moved to the fully wound position thereof illustrated in FIG. 9 so that the fan gear 66 communicates with the main drive gear 76. In this regard, as the winding arm 62 is advanced toward the wound position thereof, the ratchet arms 84 pass over the ratchet teeth 82 so that the ratchet ring 78 rotates the intermediate drive gear 80. However, when the winding arm 62 is thereafter released so that it is advanced toward the unwound position thereof by the spring 68, rotation is communicated from the main drive gear 76 to the intermediate drive gear 80, and hence rotation is also communicated to the escapement wheel 92 and the coupling drive gear 100. Accordingly, as the winding arm 62 is advanced toward the unwound position thereof, the escapement arm 94 is oscillated back and forth in the upper timer housing section 52, and the coupling gear 48 is rotated in the sleeve 60.

The game elements 16 preferably comprise substantially circular rings which are made from a magnetically responsive ferrous metal.

The feeder assembly 18 is illustrated most clearly in FIGS. 1 through 5, and it comprises a ramp portion 106 including a sidewall portion 107 and a holder member 108. The ramp portion 106 and the sidewall portion 107 are integrally formed with the support tower housing section 34 so that they cooperate to define a substantially circular downwardly inclined channel which is dimensioned for receiving the game elements 16 so that they are vertically disposed in a substantially aligned row therein. The ramp portion 106 is further adapted so that the game elements 16 naturally roll downwardly in a substantially aligned row to the holder member 108. The holder member 108 is disposed at the feeder station 26, and it is operative for sequentially receiving individual game elements 16 from the ramp portion 106 and for sequentially positioning them in substantially vertical dispositions at the feeder station 26. The holder member 108 includes an upwardly open slot 110, and it is pivotably mounted about a substantially horizontal axis on the support tower section 34 adjacent the lower end of the ramp portion 106 with a substantially horizontal pin 112. The feeder assembly 18 is further formed so that the holder member 108 communicates with the ramp portion 106 for sequentially receiving individual game elements 16 therefrom when the holder member 108 is in a substantially vertical disposition, and the holder member 108 is formed so that it is normally gravitationally retained in a substantially vertical disposition. However, because the holder member 108 is pivotably mounted on the pin 112, it can freely pivot to the position illustrated in FIG. 3 in order to effectively pass a game element 16 to the support mechanism 20 each time the support mechanism 20 is passed over the holder member 108.

The support mechanism 20 is operative for sequentially receiving individual game elements 16 from the holder member 108 and for sequentially moving them in a substantially circular path so that each of the game elements 16 is passed over the retrieving mechanism 22. The support mechanism 20 comprises a drive shaft 112, a coupling gear 114 on the drive shaft 112, and a spring 116 on the shaft 112. The drive shaft 112 is mounted in the support tower section 34 so that the coupling gear 114 intermeshes with the coupling gear 48 of the timer 14, and the spring 116 is received on the drive shaft 112 for maintaining the coupling gear 114 in biased engagement with the coupling gear 48. The drive shaft 112 extends upwardly through the aperture 40 in the upper end of the support tower section 34, and a disc 118 is received on the shaft 112 on the upper side of the upper wall of the support tower section 34. The support mechanism 20 further comprises a magnet housing 120 which is pivotably mounted on the disc 118, a permanent magnet 122 which is received in the housing 120, and a pair of magnetic arms 124. The magnetic arms 124 are made of a ferrous metal, and they are positioned so that they extend outwardly from the magnet housing 120 in diametrically opposite directions and then downwardly, and fanciful action FIGS. 126 are received on the outer ends of the arms 124. The arms 124 are mounted in the housing 120 so that they communicate with the permanent magnet 122 for maintaining the magnetic arms 124 sufficiently magnetized to support the game elements 16 on the outer ends thereof, but so that the arms 124 can be tilted upwardly and downwardly. The support assembly 20 further comprises a tubular cam sleeve 128 which is integrally formed with the support tower section 34 so that it extends upwardly around the lower portions of the magnet housing 120 for engaging the undersides of the magnetic arms 124 as the magnetic arms 124 are pivoted about the axis of the shaft 112. The cam sleeve 128 includes an upper cam edge portion 130 which extends upwardly by an increased amount and a lower cam edge portion 132 which extends upwardly by a reduced amount. Accordingly, as the magnetic arms 124 are pivoted about the axis of the shaft 112, the arms 124 engage the upper and lower edge portions 130 and 132 of the cam sleeve 128 so that the arms 124 are correspondingly tilted upwardly or downwardly. In this connection, the upper and lower cam edge portions 130 and 132, respectively, are positioned so that each of the arms 124 is maintained in an upwardly tilted position as it passes over the retrieving mechanism 22, whereas each of the arms 124 is maintained in a downwardly tilted position as it passes over the feeder station 26.

Figure 5:
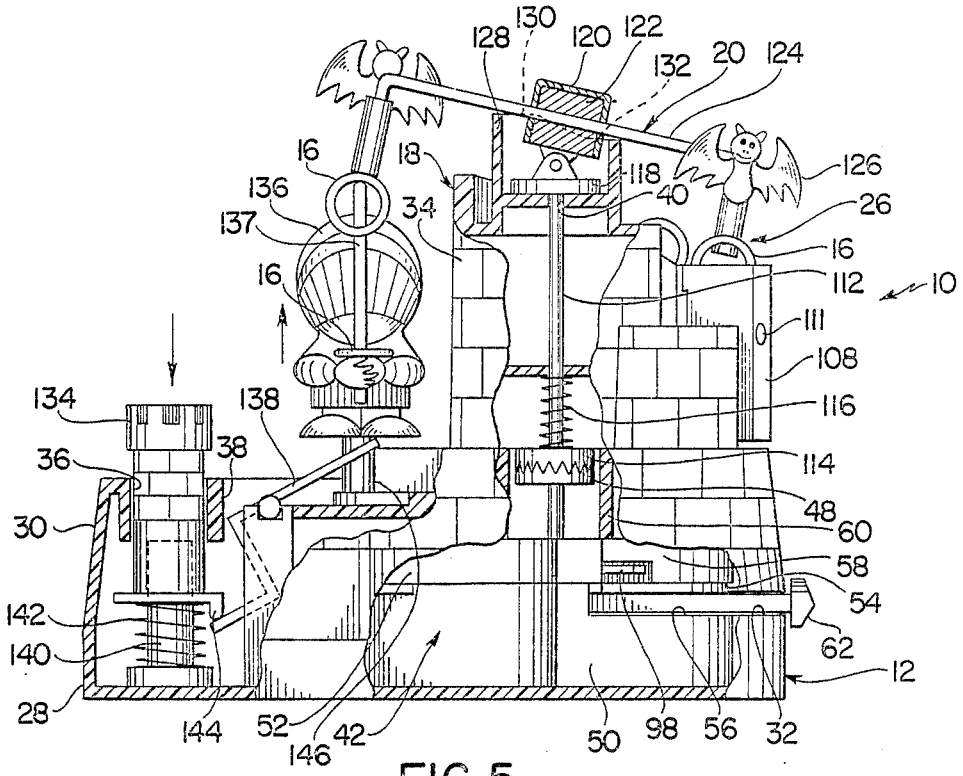
FIG. 5 is a similar view of the game apparatus illustrating the operation of the retrieving mechanism for retrieving a game element.
Figure 6:
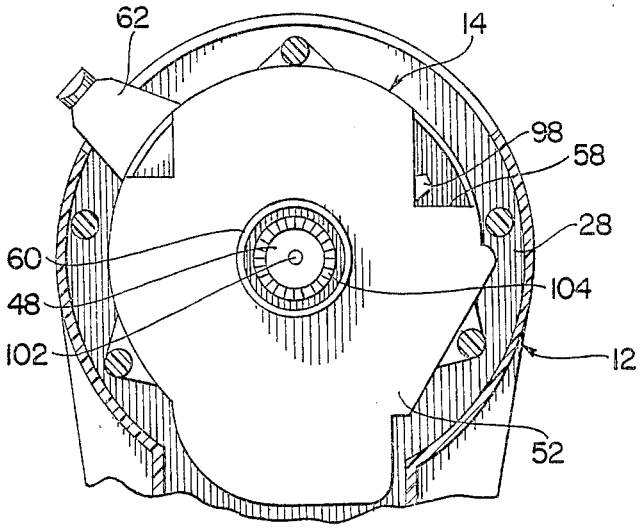
FIG. 6 is a sectional view taken along line 6—6 in FIG. 4.

The retrieving mechanism 22 is operative for retrieving the game elements 16 from the support mechanism 20, and it comprises a depressible plunger element 134, a character figure member 136, an elongated, upwardly extending rod 137, and a pivot member 138 which extends between the plunger element 134 and the character figure member 136. The plunger element 134 is received in the opening 36 in the upper housing section 30, and it is received on a shaft 140 which extends upwardly from the bottom wall of the lower housing section 28. A spring 142 biases the plunger element 134 to the upwardly extending position illustrated in FIGS. 1 and 4, and a leg 144 extends outwardly from the lower end of the plunger element 134 toward the pivot member 138. An upwardly extending shaft 146 is formed in the upper housing section 30, and the character figure member 136 is slidably received on the shaft 146 so that the character figure member 136 is upwardly movable within a preset range. The character figure member 136 is preferably embodied in the configuration of a fanciful medieval knight as illustrated, and the rod 137 is preferably embodied as a lance which is held in the hands of the character figure member 136 as illustrated. The pivot member 138 is pivotably mounted in the upper housing section 30, and it extends between the leg 144 of the plunger element 134 and the base of the character figure member 136 for moving the character figure member 136 upwardly on the rod 137 when the plunger element 134 is depressed downwardly as illustrated in FIG. 5. In this connection, the retrieving mechanism 22 is preferably adapted so that when the plunger element 134 is in a fully depressed position the upper end of the rod 137 is positioned at approximately the same height as the path followed by the lower ends of the magnetic arms 124 as the magnetic arms 124 are moved over the character figure member 136. Accordingly, by depressing the plunger element 134 at the appropriate time, it is possible to retrieve a game element 16 on the rod 137 as the game element 16 is passed over the character figure member 136 on the support mechanism 20.

Figure 3:
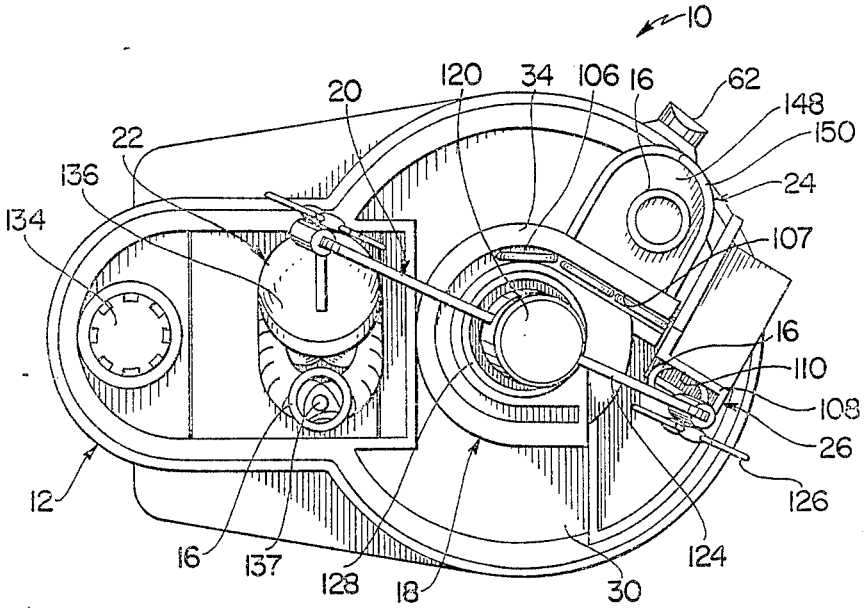
FIG. 3 is a top plan view of the game apparatus illustrating the operation of the holder member for passing a game element to the support assembly.
Figure 4:
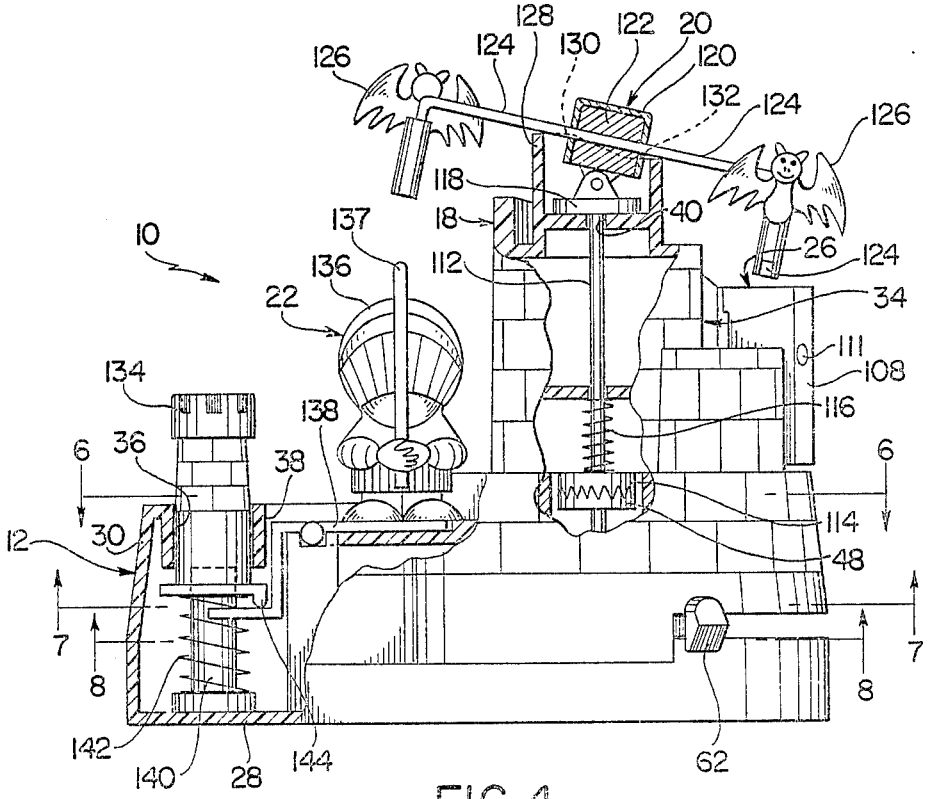
FIG. 4 is a sectional side elevational view of the game apparatus.

Referring to FIG. 3, the removing mechanism 24 is preferably integrally formed with the support tower section 34 of the housing 12, and it comprises a substantially flat horizontal shelf portion 148 and an arcuate wall portion 150 which extends upwardly from the perimeter of the shelf portion 148. The wall portion 150 is formed so that the lower ends of the magnetic arms 124 pass in closely adjacent relation to the upper edge of the wall portion 150 as the arms 124 pass over the wall 150. Accordingly, the removing mechanism 24 is operative for removing any of the game elements 16 remaining on the arms 124 after the arms 124 have been passed over the retrieving mechanism 22, and it is further operative for catching the removed game elements 16 on the shelf portion 148.

For use and operation of the game apparatus 10, a plurality of the game elements 16 are assembled in the channel defined by the ramp portion 106 and the sidewall portion 107 so that the first game element 16 rolls into the holding member 108 and is positioned at the feeder station 26 and so that the remaining game elements 16 are positioned in a substantially aligned row on the ramp portion 106. The winding arm 62 is then moved to a wound position against the force of the spring 68, and the winding arm 62 is released so that the winding mechanism 44 drives the decay mechanism 46 and so that rotation is communicated to the shaft 112 of the support mechanism 22 through the coupling gears 48 and 114. As the lower end of a first one of the magnetic arms 124 passes over the feeder station 26, the game element 16 in the holder member 108 is magnetically attracted to the magnetic arm 124, and the holder member 108 is pivoted on the pin 111. Accordingly, the game element 116 is passed to the support mechanism 22, and it is magnetically supported on the lower end of the first magnetic arm 124. As the support mechanism 22 is further rotated, the arm 124 and the game element 16 are moved upwardly by the cam sleeve 128, and the game element 16 is passed over the character figure member 136. As the game element 16 is passed over the character figure member 136, a game player can retrieve the game element 16 by depressing the plunger element 134 to move the character figure member 136 upwardly at the appropriate time so that the rod 137 is passed through the game element 16. However, in the event that the game element 16 is not retrieved on the rod 137, it is advanced to the wall portion 150, and it is wiped from the arm 124 so that it falls onto the shelf portion 148. As the same magnetic arm 124 is then again passed over the feeder station 126, a new game element 16 is magnetically secured to the magnetic arm 124 so that the new game element 16 is advanced to the retrieving mechanism 22. In this connection, the retrieving mechanism 22 is adapted so that a plurality of the game elements 16 can be effectively accommodated on the rod 137, and accordingly the retrieving mechanism 22 can be operated for retrieving as many of the game elements 16 as possible during a set period of time as determined by the timer 14.

It is seen, therefore, that the instant invention provides an effective and amusing game apparatus. The apparatus 10 is operative with interesting and amusing action movements for magnetically securing the game elements 16 on the arms 124 and for then retrieving the game elements 16 with the retrieving mechanism 22. Further, the apparatus 10 requires a significant degree of skill in order to effectively secure the game elements 16 with the rod 137 at the appropriate time. As a result, the game apparatus 10 has a high degree of amusement value, and the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An action toy game apparatus comprising a base, a timer in said base actuatable for a set period of time, a plurality of magnetically responsive game elements, feeder means for sequentially feeding said game elements to a feeder station, magnetic support means on said base communicating with said timer and rotating when said timer is in an actuated condition, said magnetic support means being operative for individually receiving sequential game elements from said feeder means at said feeder station and for magnetically supporting them so that they are individually moved in a substantially circular path which is spaced upwardly from said base, and retrieving means on said base for individually retrieving said game elements from said support means as they are moved in said substantially circular path.

2. In the action toy game apparatus of claim 1, said game elements comprising substantially circular metal rings, said retrieving means comprising an elongated rod which is receivable through said rings for retrieving them from said support means.

3. In the action toy game apparatus of claim 2, said retrieving means further comprising a character figure member holding said elongated rod.

4. The action toy game apparatus of claim 1 further comprising removing means for individually removing said rings from said support means after they have passed over said retrieving means and before they are moved a complete revolution in said substantially circular path in the event they are not first retrieved by said retrieving means.

5. In the action game apparatus of claim 1, said feeder means comprising a ramp for sequentially feeding said game elements to said feeder station.

6. In the action toy game apparatus of claim 5, said game elements comprising substantially circular rings, said ramp being constructed to maintain said rings in substantially upright dispositions thereon so that they sequentially roll toward said feeder station as said game elements are individually received by said support means.

7. In the action toy game apparatus of claim 6, said feeder means further comprising a holding member for individually receiving sequential rings from said ramp and for individually holding them at said feeder station in substantially vertical dispositions, said holding member being pivotable about a substantially horizontal axis for individually passing said rings to said support means as said support means is rotated.

8. In the action toy game apparatus of claim 1, said support means comprising at least one support arm, said support arm having a magnetic outer end and pivoting about a substantially vertical axis when said timer is in an actuated condition for moving said magnetic outer end so that it passes sequentially over said feeder station and then over said retrieving means.

9. In the action toy game apparatus of claim 8, said support arm being pivotably mounted and being pivoted so that said magnetic outer end of said support arm is lowered as it is passed over said feeder station for receiving a game element and then raised upwardly as it is passed over said retrieving means.

* * * * *